United States Patent [19]

Gliha

[11] Patent Number: 4,747,789

[45] Date of Patent: May 31, 1988

[54] FILTER ELECTRICAL CONNECTOR WITH TRANSIENT SUPPRESSION

[75] Inventor: Edward R. Gliha, Bainbridge, N.Y.

[73] Assignee: Amphenol Corporation, Wallingford, Conn.

[21] Appl. No.: 926,478

[22] Filed: Nov. 3, 1986

[51] Int. Cl.[4] ..... H01R 13/66

[52] U.S. Cl. ..... 439/620; 333/185

[58] Field of Search ..... 333/181, 182, 183, 184, 333/185; 339/147 R, 147 P; 439/608, 620

[56] References Cited

U.S. PATENT DOCUMENTS

| | | | |
|---|---|---|---|
| 4,275,945 | 6/1981 | Krantz et al. | 339/147 R |
| 4,431,251 | 2/1984 | Krantz | 339/147 R |
| 4,572,600 | 2/1986 | Nieman | 339/147 R |
| 4,582,385 | 4/1986 | Couper et al. | 339/147 R |
| 4,600,262 | 7/1986 | Nieman et al. | 339/147 R |
| 4,707,048 | 11/1987 | Gliha | 439/620 |
| 4,707,049 | 11/1987 | Gliha | 439/620 |

*Primary Examiner*—Gil Weidenfeld
*Assistant Examiner*—Gary F. Paumen
*Attorney, Agent, or Firm*—Bacon & Thomas

[57] ABSTRACT

A filter connector having a metal shell, a contact mounted in the shell for passing a signal therethrough, a filter element and a silicon diode mounted on the contact and in electrical circuit relation therewith, and ground means for grounding the contact to the shell, the silicon diode for preventing voltages from passing which exceed a predetermined value.

6 Claims, 1 Drawing Sheet

FIG. 1
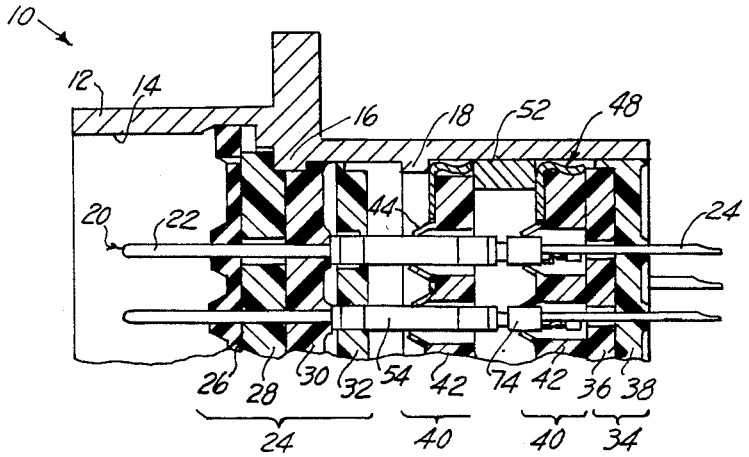
FIG. 2
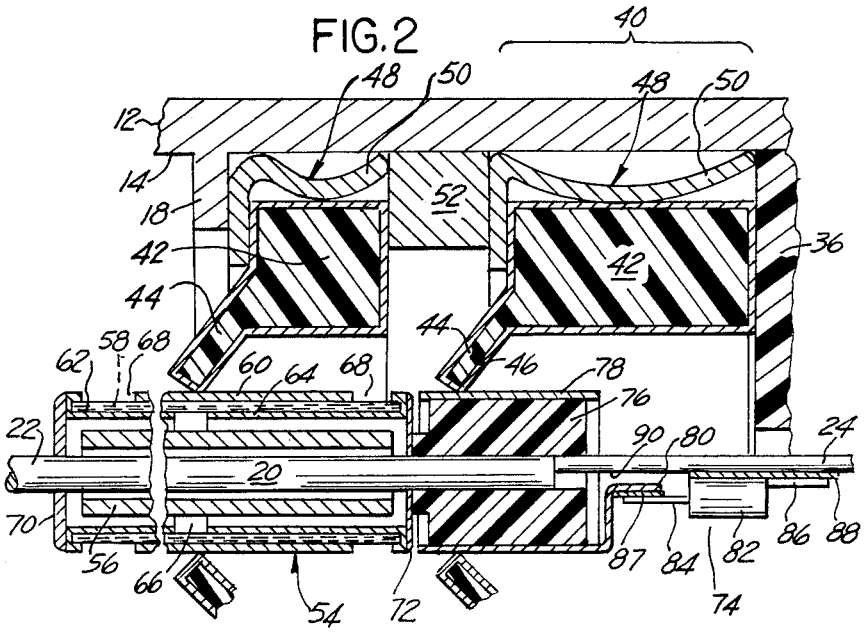
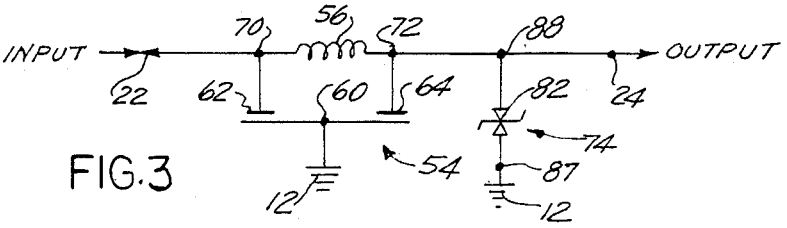
FIG. 3

FILTER ELECTRICAL CONNECTOR WITH TRANSIENT SUPPRESSION

This invention relates to a filter electrical connector with transient suppression.

With the advent of solid state electronics there has developed a serious concern about the effects of transient voltage pulses (e.g., electrostatic discharges (ESD), nuclear electromagnetic pulses (EMP) and lightening). U.S. Pat. No. 4,275,945, the specification and figures thereof being specifically incorporated by reference herein, issued June 30, 1981 to Krantz, Jr. et al for a "Filter Connector With Compound Filter Elements" and showed separate ground plates electrically grounding each of two filter elements.

Such a filter connector, while suitable for the purposes then intended, does not protect the user from voltage spikes which are of extraordinarily short duration and having sharp waveforms. It would be desirable to have a connector which filters undesired frequencies and protects its circuits from unpredictable voltage pulses which are severe but transient in nature.

Diodes are known as circuit elements which will hold a signal line to a specific voltage for which it is designed. However diodes are normally externally mounted on circuit boards and technology has only recently considered their incorporation into the internal structure of matable cylindrical connectors.

This invention relates to an electrical connector assembly which contains a silicon diode for transient overvoltage protection and a tubular ceramic filter for EMI protection. The diode can be unipolar or bipolar and is attached to the output side of the contact and is designed to divert overvoltages having extremely fast rise times to shell ground instead of being passed to the system into which the connector is incorporated. In particular, the circuit protection provided defines a pi filter.

The invention will now be described, by way of example, with reference to the following drawings in which:

FIG. 1 is a partial section view in elevation, with parts broken away, of a connector shell having an arrangement for filtering and protecting signals passing through its contacts therein from transient signals.

FIG. 2 is an enlarged view in section of a contact in the connector of FIG. 1.

FIG. 3 is an electrical circuit diagram of the connector arrangement.

Turning now to the drawings, FIG. 1 shows an electrical connector 10 which comprises a cylindrical metal shell 12 and carries electrical contacts 20. The shell is hollow from end to end and has a pair of flanges 16, 18 extending radially inward from its inner wall 14. Disposed in the shell for supporting the contacts is a forward insert assembly 24, a rearward insert assembly 34, a forward and a rearward grounding assembly 40, and a cylindrical metal spacer ring 52 for spacing the grounding assemblies from one another. An array of passages extend through the assemblies for passing the contacts.

The contact 20 includes a mating forward end 22, a wire receiving rearward end 24, and a pair of spaced circuit elements 54, 74, one circuit element comprising a filter element 54 adjacent the forward end 22 and the other circuit element comprising a silicon diode 74 adjacent the rearward end 24, the filter element receiving and filtering the input signal and the silicon diode passing the signal if it does not exceed a certain voltage but diverting the signal to shell ground if the signal does exceed a certain voltage. Although the arrangement shows the filter element being the first circuit element for protecting the contact, due to impedance factors and the nature of voltage spikes it may in some applications be desirable to reverse their positions on the contact.

The forward support assembly 24 supports the forward ends 22 of the contacts and comprises an epoxy disc 30, a dielectric insert 28 of plastic, an interfacial seal 26 of soft elastomeric material, and a seal 32 of elastomeric material. The rearward support assembly 34 supports the rearward ends 24 of the contacts and comprises a seal 36 of soft elastomeric material, and an epoxy disc 38.

The grounding assembly 40 comprises a bottle-cap shaped grounding spring 48 having its outer wall slitted to define a plurality of spring tines 50 and being sized to receive a plated insulative wafer 42, each having an array of passages therethrough to pass the respective contacts. The wafer 42 arranges a plurality of spring fingers 44 annularly around each of its passages to engage the outer periphery of the contact. The spring tines 50 complete an electrical circuit path between the shell and the wafer and the spring fingers 44 complete an electrical circuit path between the wafer and the contact. One grounding assembly 40 is positioned forwardly in the shell such that its spring fingers 44 engage the circuit element 54 and the other grounding assembly 40 is positioned rearwardly in the shell such that its spring fingers 44 engage the circuit element 74.

The metal spacer ring 52 is disposed between and contacts each of the grounding assembly 40 to complete an electrical circuit path therebetween.

The metal shell 12 constitutes an electrical ground and, as will be discussed, the circuit elements 54, 74 are connected to the electrical ground through their respective grounding assembly.

FIG. 2 is an enlarged view in section of a contact in the connector shell. The electrical contact 20 is generally cylindrical and includes the spaced circuit elements 54, 74. Circuit element 54 is a filter element and comprises a center conductor (the contact body 20), a ferrite sleeve 56 to cause the center conductor to exhibit series inductance, a dielectric ceramic sleeve 58 disposed coaxially of the center conductor, and electrodes 60, 62, and 64. Electrode 60 is the ground electrode and comprises a continuous metal layer on the outside surface of ceramic sleeve 58. Electrodes 62, 64 are the active electrodes each forming a continuous metal layer that is disposed on the inside surface of the ceramic sleeve 58 and which extends onto the outside surface of the ceramic sleeve. The active electrodes are separated from one another on the inside surface by a marginal space 66 and also are separated from one another on the outside surface and the ground electrode 60 by a coated marginal space 68, such space preferably being coated to inhibit flash-over between the electrodes. A solder clad metal washer 70, 72, respectively, connects the active electrode 62, 64 to the contact adjacent to its forward end 22.

Circuit element 74 comprises a silicon diode 82 being soldered at 88 into a notch 90 of the contact, a tubular insulator 76 being fitted about the contact body, and a metallic sleeve 78 being fitted about the insulator and having a tab 80 extending therefrom and formed L-shaped to prevent axial motion from being transmitted directly to the diode. A pair of terminals 84, 86 extend outwardly from the silicon diode 82 with terminal 84 (e.g., an cathode) being soldered at 87 to the tab 80 and terminal 86 (e.g., an anode) being soldered at 88 to the contact adjacent to its rearward end 24.

The circuit elements 54, 74 are grounded to the shell 12 as a result of the spring fingers 44 from the forward grounding assembly engaging the circuit element 54 and the spring fingers 44 from the rearward grounding assembly engaging the circuit element 74. The spacer ring 52 makes electrical contact between and spaces each grounding assembly 40 in the shell 12.

FIG. 3 shows the circuit diagram representing the structural elements. The capacitor element 54 includes the contact body 20 and exhibits series inductance because of the ferrite sleeve 56, the active electrode 62 being connected to the input of the contact 20, the ground electrode 60 being grounded to the shell 12, and the active electrode 64 being connected to the output of the contact. The silicon diode 74 is connected to the contact 20 adjacent to its output by solder 88 and is grounded to the shell through the solder 87 between tab 80 and terminal 84.

When a normal signal not representative of an overvoltage is received from the input, the signal passes through the circuit element 54 but bypasses the silicon diode 74. If the signal is a DC voltage it passes through to the output. An AC voltage passes through the contact until the frequency reaches the cut-off of the filter whereupon it is attenuated by the filter. All AC current above a certain limit and within the frequency range of the filter will be passed to ground by the filter which is protecting the diode.

When an overvoltage is presented to the contact the output is protected by the silicon diode and will hold the line to a specific voltage level for which it was designed. For a DC voltage, all voltage greater than the turn on voltage of the diode is converted to current and dissipated as heat to ground through the diode. The voltage across the diode does not decrease below its turn on voltage unless the source voltage drops or the diodes fail as a short. For an AC voltage and a bi-polar diode, the same result would obtain as that described above so that all voltage greater than the turn on voltage of the diode will be converted to current and conducted to ground.

Placing the filter as the input has an advantage that it operates as an rf sink to ground to dissipate high rf energy. The connector arrangement shown describes a contact with a bipolar diode and a pi filter. However it is to be understood that the diode can be unipolar or bi-polar and the filter can be "L", "T" or straight capacitance if desired.

Having described the invention what is claimed is:

1. An electrical filter connector assembly comprising:

a metallic shell defining an electrical ground, an elongated generally cylindrical electrically conductive contact element mounted in the shell, said contact having a forward and rearward end portion each portion being adapted to be electrically connected to the shell ground, first and second electrically conductive spring members each defining a central aperture and the apertures being coaxially aligned for receiving the contact element inserted therethrough, one said spring member completing a circuit path with said forward end portion and said shell and the other said spring member completing a circuit path with the rearward end portion and said shell, circuit protection means for protecting a signal received by said contact element, said protection means comprising a capacitor element on said forward end portion and a diode element on said rearward end portion, the circuit protection means being in electrical circuit relation with the contact element and with the shell by way of said members.

2. The connector as recited in claim 1 wherein the capacitor element and a portion of the diode element are generally cylindrical, each having a conductive outer periphery coaxial to the contact element and defined by a like diameter, and the capacitor element is forward of the diode element and receives an input signal.

3. The connector as recited in claim 1, wherein said capacitor element comprises a ferrite sleeve and a dielectric ceramic sleeve disposed coaxially to the forward portion of the contact element.

4. The connector as recited in claim 1, wherein said diode element comprises a silicon diode.

5. The connector as recited in claim 1, wherein the contact element is longitudinally extending and includes an input for receiving the signal and an output for passing the signal, the capacitor element being disposed adjacent to the input and the diode element being disposed adjacent to the output, both the capacitor element and the diode element being spaced from and separately grounded to the shell.

6. The connector as recited in claim 4, wherein the diode element comprises a cylindrical metal sleeve in electrical circuit contact to the shell and having a tab extending radially inward therefrom, a silicon diode, and a pair of metal terminals extending from the diode, one soldered to the contact and the other soldered to the tab to complete an electrical path to the shell.

* * * * *